US006723024B2

(12) United States Patent
Levine

(10) Patent No.: US 6,723,024 B2
(45) Date of Patent: Apr. 20, 2004

(54) LUNG AND BREATH CONTROL EXERCISE METHOD AND APPARATUS

(76) Inventor: Michael Levine, 4321 Clemson Dr., Garland, TX (US) 75042

( * ) Notice: Subject to any disclaimer, the term of this patent is extended or adjusted under 35 U.S.C. 154(b) by 0 days.

(21) Appl. No.: 09/812,061

(22) Filed: Mar. 19, 2001

(65) Prior Publication Data

US 2002/0132704 A1 Sep. 19, 2002

(51) Int. Cl.[7] ..... A63B 23/18
(52) U.S. Cl. ..... 482/13; 482/148
(58) Field of Search ..... 482/13; 128/716, 128/719, 720, 725, 726, 848; 446/217, 176, 418; D17/1; 273/317; 84/1, 600

(56) References Cited

U.S. PATENT DOCUMENTS 2,850,283 A * 9/1958 Lemelson ..... 273/95
3,168,983 A * 2/1965 Bosak ..... 239/211
4,041,935 A * 8/1977 Garbe ..... 128/2.08
4,347,853 A * 9/1982 Gereg et al. ..... 128/725
4,758,197 A * 7/1988 Lee ..... 446/213
5,540,234 A * 7/1996 Lalui ..... 128/725
6,270,462 B1 * 8/2001 Mottram et al. ..... 600/529

* cited by examiner

*Primary Examiner*—Nicholas D. Lucchesi
*Assistant Examiner*—Lori Baker Amerson

(57) ABSTRACT

A lung and breath control exercise device includes an elongated body with an upwardly open channel. An array of pegs are rotatably mounted on an axle extending along the channel and the pegs may be rotated from a first position against one wall of the channel to a second position against the opposite wall. In use, the pegs are positioned in one position and the device is placed on a level surface a predetermined distance from a human user. The user then blows his or her breath on the pegs to blow them to their second positions in a predetermined order or sequence or to keep selected pegs suspended between positions. This exercises the user's lungs and develops breath control. The immediate feedback provided by the moving pegs is a measure of success and progress, which encourages the user to engage and continue to engage in breath and lung exercises with the device.

17 Claims, 2 Drawing Sheets

LUNG AND BREATH CONTROL EXERCISE METHOD AND APPARATUS

TECHNICAL FIELD

The present invention relates generally to lung and breath control exercises and more particularly to an exercise device and methodology for exercising the lungs and developing breath control.

BACKGROUND

Developing good breath control and lung strength is important in a number of disciplines, primary among which is the playing of wind instruments such as trumpets, trombones, flutes, clarinets, and others. Musicians who play such instruments must, by some means, learn the skills of sustained controlled breath necessary to play their instruments properly. This is particularly true for young musicians such as, for example, members of high school bands, who must develop lung strength and learn breath control early in order to master their instruments. It is even true for professional musicians, who must exercise their lungs and practice breath control continuously to maintain their playing skills.

In many cases, traditional lung and breath control exercises employed by high school band leaders and professional musicians are crude, boring, and monotonous. As a result, it is difficult, especially in the case of young fledgling musicians, to maintain a regimen of breath control exercises because the traditional exercises are viewed as undesirable work rather than a pleasurable activity. Indeed, many young musicians never really learn to enjoy playing their wind instruments because they do not engage in the lung and breath control exercises necessary to allow them to play well.

Lung strength exercises also can be important for non-musicians such as, for example, people with lung impairments such as emphysema, asthma, cystic fibrosis, and other diseases that may affect the proper functioning of the lungs. Such individuals often are instructed by their doctors to engage in a regimen of daily lung exercises. Unfortunately, these exercises, like the traditional exercises used by musicians, are boring and monotonous and thus fail to encourage and in fact can discourage the type of intense and consistent exercises that should be observed.

One reason that traditional lung and breath control exercises are viewed as unpleasant tasks is that they rarely include the type of direct personal feedback required to signal directly to the user when an appropriate level of exercise or an appropriate mastering of breath control has been reached. While physical exercise devices such as, for example, stair climbers and exercise bikes have incorporated such feedback for many years, lung strength and breath control exercises have not advanced in a like manner. The old traditional breath control methods used for generations to strengthen the lungs and develop breath control of musicians and others still are employed today.

Thus, there exists a need for an apparatus and a methodology for exercising the lungs, developing lung capacity and strength, and developing good breath control that addresses and resolves the problems and shortcomings of the prior art. Such an apparatus and methodology should be fun and not boring so as to encourage people to engage in their exercises, should provide direct and immediate feedback as indications both of improving lung strength and breath control skills, and should be employable in a variety of specific ways to develop various types of breath control and strength needed by players of wind instruments and otherwise. It is to the provision of such a lung strength and breath control exercise apparatus and methodology that the present invention is primarily directed.

SUMMARY OF THE INVENTION

Briefly described, the present invention, in a preferred embodiment thereof, comprises a unique exercise device and exercise methodology for developing lung strength and breath control. The exercise device and methodology is envisioned primarily for use by musicians who play wind instruments to develop the level of lung strength and breath control necessary to play their instruments properly and well. It is particularly useful in the early training of young musicians such as members of high school bands so that they learn to play well and enjoy playing their wind instruments. However, the device and methodology also may be used by professional musicians and other experienced players to improve and hone breath control skills in order to improve their performance. Uses also include exercises for those with lung ailments such as asthma or emphysema, who have been prescribed a regimen of exercises to get trapped air out of the lungs, or the elderly who wish to maintain good lung capacity and resultant stamina. The invention will be described in the remaining portion of this specification within the context of its use by musicians to develop lung capacity and breath control, since this is a primary intended use of the invention. However, it should be understood that the invention is not and should not be interpreted to be limited so such use and may have a wide variety of uses whenever lung strength, lung capacity, and/or breath control skills are to be developed.

In a preferred embodiment the device comprises an elongated body having side walls and end walls that define an upwardly open channel extending along the length of the body. A rod or axle is mounted within and extends along the length of the channel and a plurality of side-by-side pegs are rotatably mounted on the axle. Each of the pegs is separated from its neighbors by a spacer, which may be one or more beads mounted on the axle. The pegs extend upwardly out of the channel. Each peg can be rotated on the axle between a first position wherein the peg rests or leans against one of the side walls on one side of the channel and a second position wherein the peg rests or leans against the opposite side wall. The length, weighting, mounting geometry, and shape of the pegs determine how much force is required to move or flip the pegs from their first positions to their second positions.

In use of the exercise device to carry out lung and breath control exercises according to the invention, the pegs preferably all are flipped to one side so that they all lean against one of the side walls of the channel. The device may then be held by a user, placed on a table or other level surface. The user positions himself a predetermined distance from the device and begins to blow the pegs over to their second positions leaning against the opposite wall of the channel. The pegs may be blown over in a wide variety of different ways to develop an equally wide variety of lung strength and breath control skills. For example, the user may take a deep breath and blow over as many pegs as possible before exhausting the breath to develop basic lung capacity and strength. Instant feed back in the form of the number of pegs blown over tracks the increasing lung strength of the user form exercise to exercise. To develop more subtle skills such as, for example, fine breath control, the user may follow an exercise regimen that includes blowing over only selected ones of the pegs such as, for instance, every other peg. The device may even be turned upside-down so that the pegs hang from the axle. In such a configuration, fine breath control and endurance can be practiced by blowing on the pegs to maintain them against one of the walls of the device or at a specified distance from the wall for as long as possible.

In one embodiment, it is envisioned that the exercise device of this invention incorporates electronic feedback and score keeping circuitry to enhance the use of the device. For instance, a microprocessor and timer or metronome may be included so that specific exercises can be timed and the microprocessor may be programmable to, for instance, gradually increase or decrease the time allotted to specific exercises as the user develops strength and control. Sensors and small LEDs coupled to the microprocessor for detecting and indicating visually the status of each peg are contemplated to keep score electronically of the performance and progress of the user. The sensors, LEDs, timer, and other electronics are coupled to and operated by the on-board micro-controller or microprocessor. In this way, a wide variety of exercises for developing various lung strength and breath control skills may be programmed into the microprocessor, which may, for instance, indicate with the LEDs which pegs are to be blown over and in which sequence for a particular exercise. The microprocessor also may keep track of and display the user's progress and change the conditions of exercises to match the users developing lung strength and breath control skills.

Accordingly, a lung strength and breath control exercise apparatus and methodology is now provided that overcomes the problems of the prior art. It has been found that musicians, and especially young musicians, actually enjoy using the device to exercise their breath control and even can enjoy competing with each other as they progress. Professional musicians have reported that their lung strength and breath control skills have been honed and improved by using the exercise device of this invention. Instant feedback in the form moved pegs in a simple embodiment and/or electronic scoring and exercise control in a more complex embodiment informs the user that he has performed an exercise properly and that lung strength and breath control skills are improving over time. These and other features, objects, and advantages of the invention will become more apparent upon review of the detailed description set forth below taken in conjunction with the accompanying drawing figures, which are briefly described as follows.

DETAILED DESCRIPTION OF THE PREFERRED EMBODIMENTS

Figure 1:
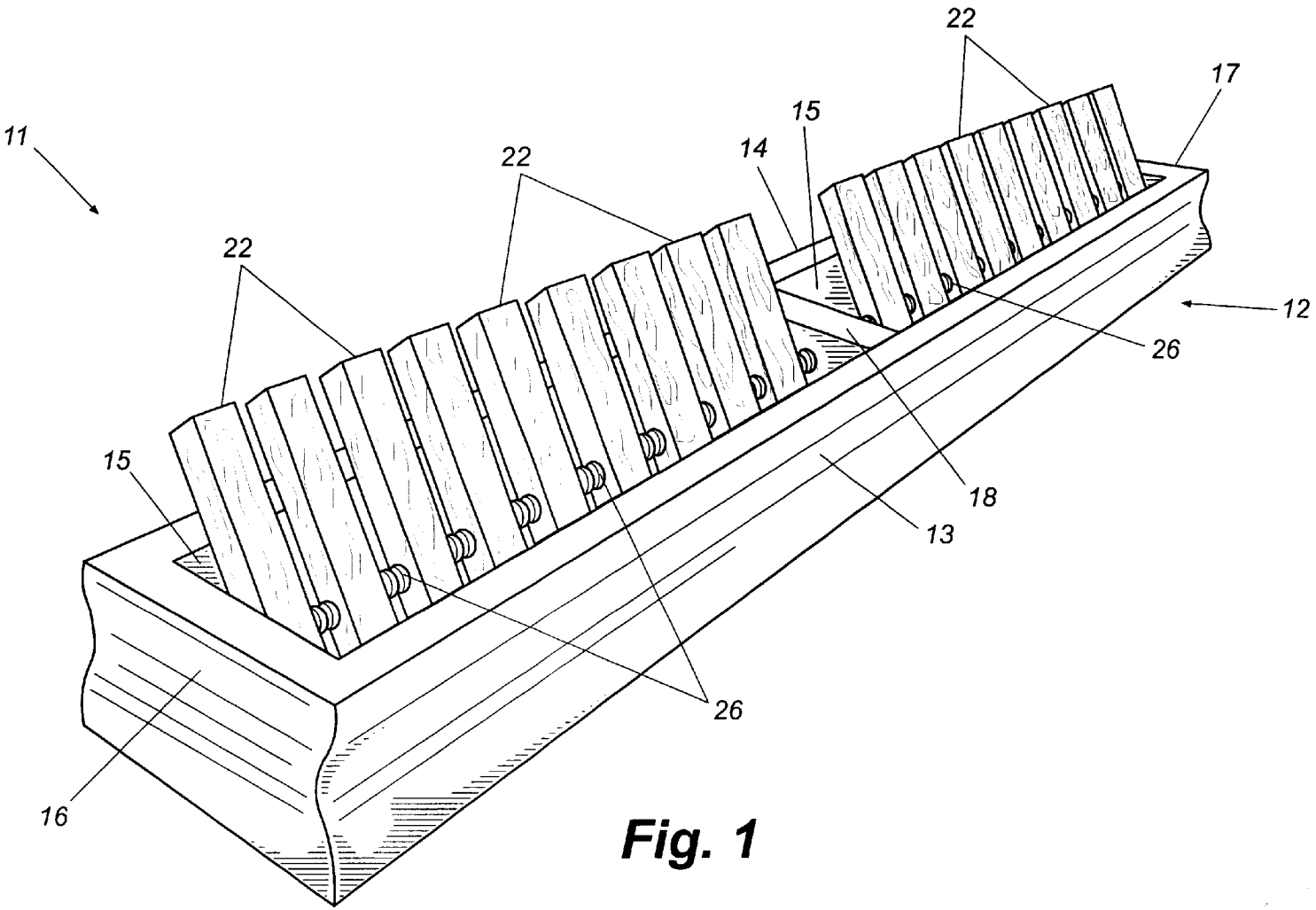
FIG. 1 is a perspective view of a lung and breath control exercise device that embodies principles of the present invention in one preferred form.

Referring now in more detail to the drawings, in which like reference numerals refer to like parts throughout the several views, FIG. 1 illustrates, in a perspective view, one preferred embodiment of the exercise device of the present invention. The device 11 comprises a body 12 formed from a first side wall 13 and a second side wall 14 connected at their ends by end walls 16 and 17. A bottom 19 (FIG. 2) closes the bottom of the body 12 such that it defines an elongated upwardly open channel 15 extending along the length of the device 11. A divider or partition wall 18 may be provided if desired to enhance the strength of the device and to divide the upwardly open channel into two sections.

An elongated rod or axle 21 is mounted within and extends along the length of the channel 15 from one of the end walls 16 to the other end wall 17. The axle 21 may conveniently be made of metal or another appropriate material. An array of individual pegs 22 have bores formed through them near their bottom ends and the axle 21 extends through these bores to mount the pegs in side-by-side relationship within the upwardly open channel 15. The bores in the pegs are slightly larger than the axle. With such a configuration, it will be seen that each of the pegs 22 is rotatably movable on the axle 21 between a first position 23 (in phantom line in FIG. 2) resting or leaning against the top of side wall 14, and a second position 24 leaning against the top of the side wall 13. Preferably, spacers 26, which may take the form of one or more wooden, ceramic, or plastic beads, are mounted on the axle 21 between each of the pegs to provide a space between the pegs and to prevent the pegs from interfering with each other during operation.

Figure 2:
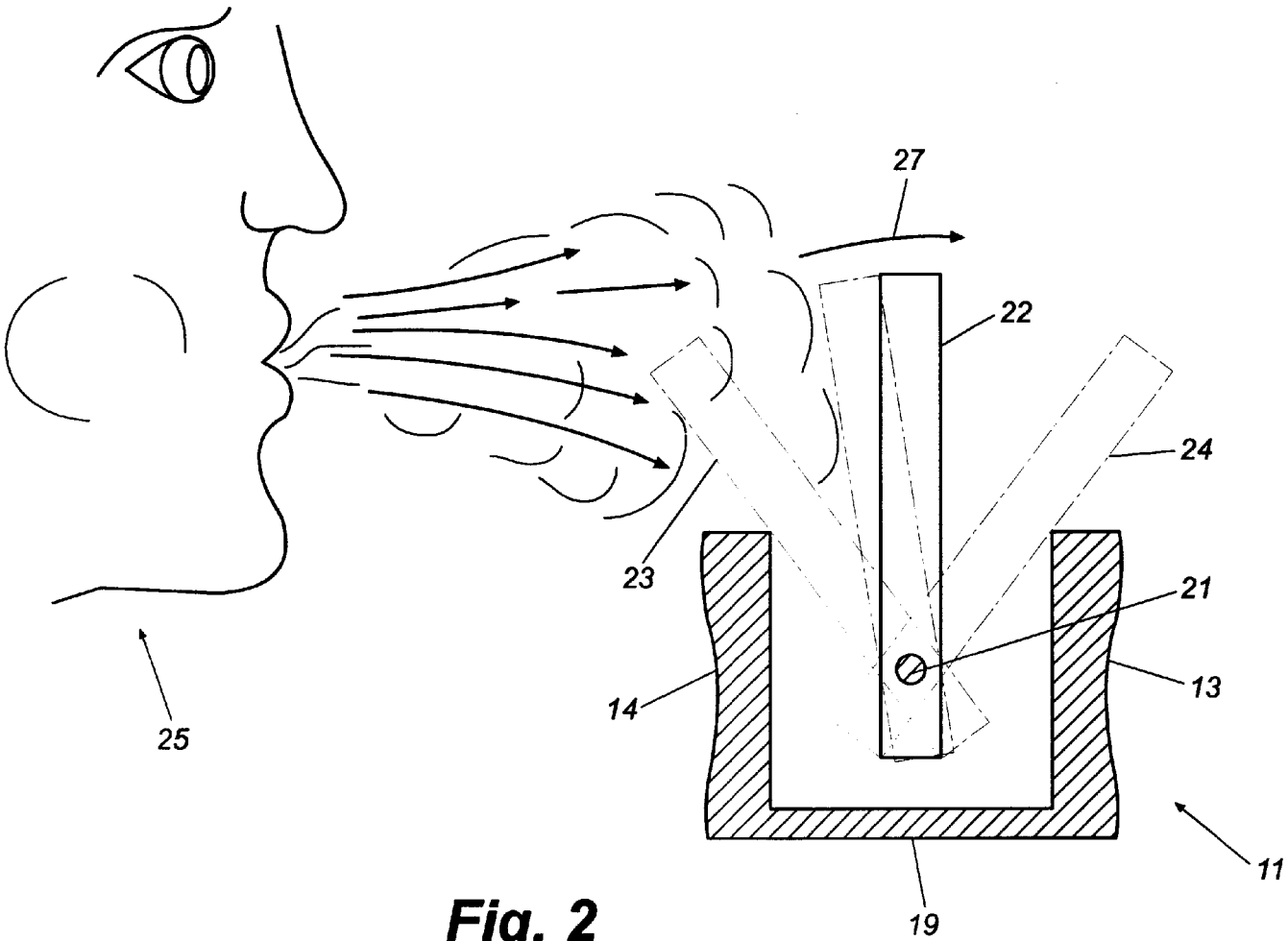
FIG. 2 is a cross-sectional view of the exercise device of FIG. 1 illustrating its use to carry out the exercise methodology of the invention.

Use of the exercise device of this invention to carry out exercises according to the methodology of the invention is illustrated graphically in FIG. 2. The exercise device is illustrated oriented upwardly as it may appear when resting on a level surface. Preferably, but not necessarily, an exercise begins with all the pegs rotated to rest against the side of the body nearest the user (side 14 in FIG. 2). The user then positions himself a predetermined distance from the device, which may vary depending upon the specific exercise or skill to be practiced, and commences to blow on the top portions of the pegs. The force of the user's breath, if sufficiently strong, causes a peg or pegs to be rotated from its first position 23 to its second position 24, as illustrated by arrow 27 in FIG. 2. When an exercise is complete, the pegs may be reset simply by lifting the device and tilting it to return all of the pegs to their first positions.

With the basic exercise device and its basic use as just described, it will be seen that a wide variety of exercises designed to develop lung strength and capacity and to develop breath control may be practiced. For example, in order to develop basic lung strength and capacity, a user may simply position himself at a predetermined distance from the device, take a deep breath, and commence to "blow over" as many pegs as possible before the breath is completely exhausted. When used in this way, the device provides and exercise similar to blowing out the candles of a birthday cake. As the user's lung capacity and lung strength improves with periodic use of the device, the number of pegs that are able to be blow over will increase, providing the user with direct visible feedback of his progress and of his developing lung strength and capacity.

The exercise device of this invention is perhaps more useful because of the subtle breath control exercises that can be practiced with the device. It is well known that musicians who play wind instruments must develop the ability to control their breath accurately in order play their instruments well. This means that they must learn to control and sustain the velocity of an exhaled breath, change to different breath velocities accurately and in time with the music, and to change accurately the direction of the exhaled breath. Other breath control skills also must be developed and maintained by these musicians and the exercise device of this invention may be used in a variety of ways to develop and enhance these types of skills. For example, an exercise regimen may be employed wherein the user is to position himself a predetermined distance from the device and control his breath so as to blow over only specified ones of the pegs such as, for instance, every other peg. Alternatively, an exercise may dictate that a user blow just hard enough to keep a peg or pegs suspended between its first position and a vertical position without allowing it to fall back to the first position or fall forward to the second position. Such an exercise helps to develop the control and sustain of a user's breath. Another possible exercise might involve blowing over pegs in a prescribed order or sequence to develop control of the direction of a user's breath, which can be important when playing the flute or other types of wind instruments.

A wide and virtually endless variety of exercises such as these may be developed for developing lung strength and capacity and for developing subtle breath control necessary to play a wind instrument well. In all such exercises, the device of this invention, unlike traditional exercises, provides direct visual feedback to the user to indicate accomplishment and progress. This feedback, in turn, has been found to make the exercises challenging and even fun. In fact, as mentioned above, young musicians have been known to compete with each other as if the exercises were a game and, while having fun, developing their musical skills. Professional musicians have reported that use of the exercise device provides incentive to perform their lung and breath exercises and that the exercises themselves actually result in a honing and improvement of their breath control skills, which translates into improved performance.

Enhanced embodiments of the invention are contemplated to improve the nature and quality of the feedback. For example, an on-board microprocessor or micro-controller, sensors to sense the status of the pegs, a timing clock, and LEDs to indicate visually the status of the pegs are envisioned in one enhanced embodiment. In such an embodiment, the sensors and LEDs are electronically coupled to the microprocessor, which, in turn, receives status from the sensors and can turn on the LEDs to indicate one or more of the pegs to a user. In this way, specific exercises may be programmed into the microprocessor which may, for example, start an exercise by turning on the LEDs of pegs to be blown over or turning them on in a predetermined sequence for blowing over. When an appropriate peg is blown over within a prescribed time, the microprocessor senses the event. Likewise, if the proper peg is not blown over, this is noted as well. In this way, the microprocessor easily may keep score and may store the scores over time to keep track of the progress of the user in developing his breath control skills. Games may be programmed into the microprocessor with one user competing against another to obtain a higher score. Further, instrument or user specific exercise regimens may be developed and programmed into the microprocessor for specific development goals. These and many other uses of such an enhanced computerized version of the exercise device of this invention may well be developed by those skilled in the art, all within the scope of the invention disclosed herein.

The invention has been described above in terms of preferred embodiments and methodologies, which represent the best mode known to the inventor of carrying out the invention. It will be appreciated, however, that many modifications to the disclosed embodiments are possible, all within the scope of the invention. For instance, the invention has been described in terms of its use by musicians to develop lung strength and breath control skills. As mentioned briefly above, however, the invention also may be used by persons with lung ailments who need to exercise their lungs or, indeed, by athletes, scuba divers, or anyone else who desires to increase lung capacity, lung strength, and breath control through a regimen of unique exercises.

Further, the physical structure of the exercise device may well be different from that of the preferred and illustrated embodiment. For instance, the pegs may be round or otherwise sculpted rather than square and, even though the device of the illustrated embodiment is made of wood, it clearly may be constructed of plastic or any other appropriate material. The pegs themselves may be made of a heavy wood such as oak for aggressive exercises or light wood such as balsa for lighter more subtle exercises. Alternatively, the pegs may be made of molded plastic or, for very light and sensitive pegs, may be hollow plastic that is extruded or molded. Such light pegs are useful for very subtle exercises such as, for example, exercises designed to develop lip pursing skills needed for certain instruments such as the oboe. In its broadest sense, the invention does not necessarily even require rotatable pegs that may be blown over. Any structure against which a user may blow and generate a measurable effect that produces feedback for the user is contemplated as being within the scope of the invention. Finally, the invention is not and should not be interpreted to be limited to the specific exercises and method of use discussed in conjunction with the preferred embodiment. Indeed, any exercise regimen designed to enhance and improve a user's lung strength, lung capacity, breath control, and breath sustain is intended to be within the scope of the invention. These and other additions, deletions, and modifications may well be made to the illustrated embodiments by those of skill in the art without departing from the spirit and scope of the invention disclosed in this provisional patent application.

What is claimed is:

1. An exercise device for developing lung strength and breath control in human users, said exercise device comprising:

a body a plurality of movable elements attached to said body whose positions may be affected by the blowing of a user's breath onto said movable elements;

each of said movable elements providing feedback to a user of its position when affected by the blowing of the user's breath on said elements.

2. An exercise device as claimed in claim 1 and wherein said elements are pegs that are moved from a first position to a second position in response to the blowing of breath onto said pegs.

3. An exercise device as claimed in claim 2 and wherein said pegs are rotatably mounted in side-by-side relationship on an elongated axle.

4. An exercise device as claimed in claim 3 and wherein said body defines an elongated upwardly open channel, said axle being mounted within said channel extending along the length thereof with said pegs projecting out of said channel.

5. An exercise device as claimed in claim 4 and wherein said channel is bounded by spaced sides of said body, said pegs being rotatable on said axle in response to the blowing of breath thereon between a first position leaning against one of said sides and a second position leaning against the other one of said sides, the movement of said pegs in response to the blowing of breath thereon providing visual feedback to a user when affected by the blowing of breath on said pegs.

6. An exercise device as claimed in claim 5 and further comprising a plurality of spacers on said axle between said pegs, said spacers spacing said pegs from each other.

7. An exercise device as claimed in claim 6 and wherein said spacers comprise beads.

8. An exercise device as claimed in claim 7 and wherein said beads are fabricated of wood.

9. An exercise device as claimed in claim 7 and wherein said beads are fabricated of plastic.

10. An exercise device as claimed in claim 4 and wherein said pegs of made of wood.

11. An exercise device as claimed in claim 4 and wherein said pegs are made of plastic.

12. An exercise device as claimed in claim 4 and wherein said pegs are rectangular in cross-section.

13. An exercise device as claimed in claim 1 and further comprising electronic means for detecting the conditions of said elements and for displaying visual feedback to a user.

14. A method of exercising the lungs of a human user and for developing breath control, said method comprising the steps of:

(a) providing a plurality of movable elements attached to a body whose positions may be affected by the blowing of human breath onto the elements; and (b) indicating through feedback to a user the positions of the elements as the user blows breath onto the elements.

15. The method of claim 14 and wherein step (a) comprises providing a plurality of pegs rotatably mounted on an axle secured to the body, the rotational position of the pegs on the axle being affected by the blowing of breath onto the pegs.

16. The method of claim 15 and where in step (b) the rotational positions of the pegs on the axle provides a visual indication of conditions of the pegs.

17. The method of claim 16 and wherein the pegs and axle are mounted within an upwardly extending channel defined by the sides of the body with the pegs projecting out of the channel, the pegs being rotatable between a first position leaning against one side of the channel and a second position leaning against the other side of the channel, the pegs being movable from their first to their second positions in response to the blowing of breath onto the pegs.

* * * * *